United States Patent [19]

Sharp et al.

[11] 4,193,771

[45] Mar. 18, 1980

[54] ALKALI METAL RECOVERY FROM CARBONACEOUS MATERIAL CONVERSION PROCESS

[75] Inventors: David W. Sharp, Seabrook; LeRoy R. Clavenna, Baytown, both of Tex.; Martin L. Gorbaty, Fanwood, N.J.; Joe M. Tsou, Galveston, Tex.

[73] Assignee: Exxon Research & Engineering Co., Florham Park, N.J.

[21] Appl. No.: 903,635

[22] Filed: May 8, 1978

[51] Int. Cl.[2] ..... C10J 3/06

[52] U.S. Cl. ..... 48/197 R; 48/202; 48/210; 252/412; 252/413; 252/420; 208/9; 423/206 R; 423/208

[58] Field of Search ..... 48/197 R, 202, 210; 252/373, 411, 412, 420, 413; 423/111, 119, 127, 203, 206 R, 208, 658.5; 208/10, 9; 201/38

[56] References Cited

U.S. PATENT DOCUMENTS

| | | | |
|---|---|---|---|
| 3,033,647 | 5/1962 | Yamazaki | 423/203 |
| 3,998,607 | 12/1976 | Wesselhoft et al. | 423/206 R |
| 4,057,512 | 11/1977 | Vadovic et al. | 252/413 |

OTHER PUBLICATIONS

"Coal Gasif. with Chemically Incorporated Catalysts", O'Hara, Synthetic Fuels Process Research Digest, Nov. 1977.

*Primary Examiner*—S. Leon Bashore
*Assistant Examiner*—Peter F. Kratz
*Attorney, Agent, or Firm*—Yale S. Finkle

[57] ABSTRACT

In a coal gasification operation or similar conversion process carried out in the presence of an alkali metal-containing catalyst wherein solid particles containing alkali metal residues are produced in the gasifier or similar reaction zone, alkali metal constitutents are recovered from the particles by withdrawing and passing the particles from the reaction zone to an alkali metal recovery zone in the substantial absence of molecular oxygen and treating the particles in the recovery zone with water or an aqueous solution in the substantial absence of molecular oxygen. The solution formed by treating the particles in the recovery zone will contain water-soluble alkali metal constituents and is recycled to the conversion process where the alkali metal constituents serve as at least a portion of the alkali metal constituents which comprise the alkali metal-containing catalyst. Preventing contact of the particles with oxygen as they are withdrawn from the reaction zone and during treatment in the recovery zone avoids the formation of undesirable alkali metal constituents in the aqueous solution produced in the recovery zone and insures maximum recovery of water-soluble alkali metal constituents from the alkali metal residues.

15 Claims, 5 Drawing Figures

ALKALI METAL RECOVERY FROM CARBONACEOUS MATERIAL CONVERSION PROCESS

The government of the United States of America has rights in this invention pursuant to Contract No. E(49-18)-2369 awarded by the U.S. Energy Research and Development Administration.

BACKGROUND OF THE INVENTION

1. Field of the Invention

This invention relates to the conversion of coal and similar carbonaceous solids in the presence of alkali metal-containing catalysts and is particularly concerned with the recovery of alkali metal constituents from spent solids produced during coal gasification and similar operations and their reuse as constituents of the alkali metal-containing catalysts.

2. Description of the Prior Art

Potassium carbonate, cesium carbonate and other alkali metal compounds have been recognized as useful catalysts for the gasification of coal and similar carbonaceous solids. The use of such compounds in coal liquefaction, coal carbonization, coal combustion and related processes has been proposed. To secure the higher reaction rates made possible by the presence of the alkali metal compounds it has been suggested that bituminous coal, subbituminous coal, lignite, petroleum coke, oil shale, organic wastes and similar carbonaceous materials be mixed or impregnated with potassium, cesium, sodium or lithium compounds, alone or in combination with other metallic constituents, before such materials are reacted with steam, hydrogen, oxygen or other agents at elevated temperatures to produce gaseous and/or liquid products. Studies have shown that a wide variety of different alkali metal compositions can be used for this purpose, including both organic and inorganic salts, oxides, hydroxides and the like. In genral the above-described studies indicate that cesium compounds are the most effective gasification catalysts followed by potassium, sodium and lithium compounds in that order. Because of the relatively high cost of cesium compounds, most of the experimental work performed in this area in the past has been directed toward the use of compounds of potassium and sodium. This work has shown that the potassium compounds are substantially more effective than the corresponding sodium compounds. Attention has therefore been focused on the use of potassium carbonate.

Coal gasification processes and similar operations carried out in the presence of alkali metal compounds at high temperatures generally result in the formation of chars and alkali metal residues. The chars normally include unconverted carbonaceous constituents of the coal or other feed material and various inorganic constituents generally referred to as ash. It is generally advisable to withdraw a portion of the char from the reaction zone during gasification and similar operations in order to eliminate the ash and prevent it from building up within the reaction zone or other vessels in the system. Elutriation methods and other techniques for separating char particles of relatively high ash content and returning particles of relatively low ash content to the reaction zone in order to improve the utilization of carbon in such processes have been suggested. In gasification and other processes referred to above that utilize alkali metal-containing catalysts, the cost of the alkali metal constituents is a significant factor in determining the overall cost of the process. In order to maintain catalyst cost at reasonable levels, it is essential that the alkali metal constituents be recovered and reused. There have been proposals for the recovery of alkali metal constituents by leaching as they are withdrawn from the reaction zone with char during operations of the type referred to above. Studies indicate that these constituents are generally present in part as carbonates and other water soluble compounds which can be at least partially recovered by water washing. There has, however, been relatively little work done in this area.

SUMMARY OF THE INVENTION

The present invention provides an improved process for the recovey of alkali metal constituents from mixtures of char, ash and alkali metal residues produced during coal gasification and other conversion processes carried out in the presence of an alkali metal-containing catalyst. In accordance with the invention it has now been found that increased amounts of alkali metal constituents can be effectively recovered from particles containing alkali metal residues produced in the reaction zone of a coal gasification or related high temperature conversion process by withdrawing and passing the particles from the reaction zone to an alkali metal recovery zone in the substantial absence of molecular oxygen and thereafter treating the particles in the recovery zone with water or an aqueous solution in an atmosphere substantially free of oxygen to form an aqueous solution containing water-soluble alkali metal constituents. These alkali metal constituents are then used in the conversion process as at least a portion of the alkali metal constituents which comprise the alkali metal-containing catalyst. Preferably, such use is achieved by recycling the aqueous solution containing the water-soluble alkali metal constituents to the conversion process. If desired, however, the alkali metal constituents may first be recovered from the solution and then used in the conversion process. By preventing the exposure of the particles containing the alkali metal residues to air or other gas containing molecular oxygen during their withdrawal and passage from the reaction zone to the alkali metal recovery zone and during treatment in the recovery zone, the formation of undesirable alkali metal constituents such as alkali metal sulfates, alkali metal thiosulfates and the like in the aqueous solution produced during the treatment step is averted and a greater amount of alkali metal constituents is recovered from the particles that could otherwise be recovered if the particles were exposed to oxygen.

The invention is based in part upon laboratory studies which indicate that when char produced from the fluid bed gasification of a coal impregnated with an alkali metal carbonate is exposed to air and subsequently water washed, the resulting solution will contain not only alkali metal carbonates and alkali metal hydroxides but also significant amounts of undesirable alkali metal sulfates and alkali metal thiosulfates. Both of these latter compounds are undesirable for reuse as constituents of the alkali metal-containing catalyst. The alkali metal sulfate is known to have a low catalytic activity as compared to the alkali metal carbonate or hydroxide and a portion of the alkali metal thiosulfate will be converted into the alkali metal sulfate when subjected to gasification conditions upon reuse. Laboratory studies have also shown that when char is exposed to air, the quantity of alkali metal constituents that can be effectively recovered by water washing may be decreased as much as 50 percent. These laboratory studies indicate the importance of maintaining an atmosphere free of air or other gas containing molecular oxygen while the particles containing the alkali metal residues are withdrawn from the reaction zone of the conversion process, passed to the alkali metal recovery step and subsequently treated with water or an aqueous solution to recover alkali metal constituents. This can be effectively accomplished by blanketing the char with a gas such as steam, nitrogen or cabon dioxide in such a manner as to avoid contact with oxygen or air.

The process of this invention makes it possible to increase the amount of alkali metal constituents recovered while at the same time insuring that the alkali metal constituents that are recovered will have a relatively high catalytic activity. This in turn results in a substantial decrease in the amount of makeup alkali metal compounds necessary. As a result the invention makes possible substantial savings in gasification and other conversion operations carried out in the presence of alkali metal-containing catalysts and permits the generation of product gases and/or liquids at significantly lower cost than would otherwise be the case.

DESCRIPTION OF THE PREFERRED EMBODIMENTS

Figure 1:
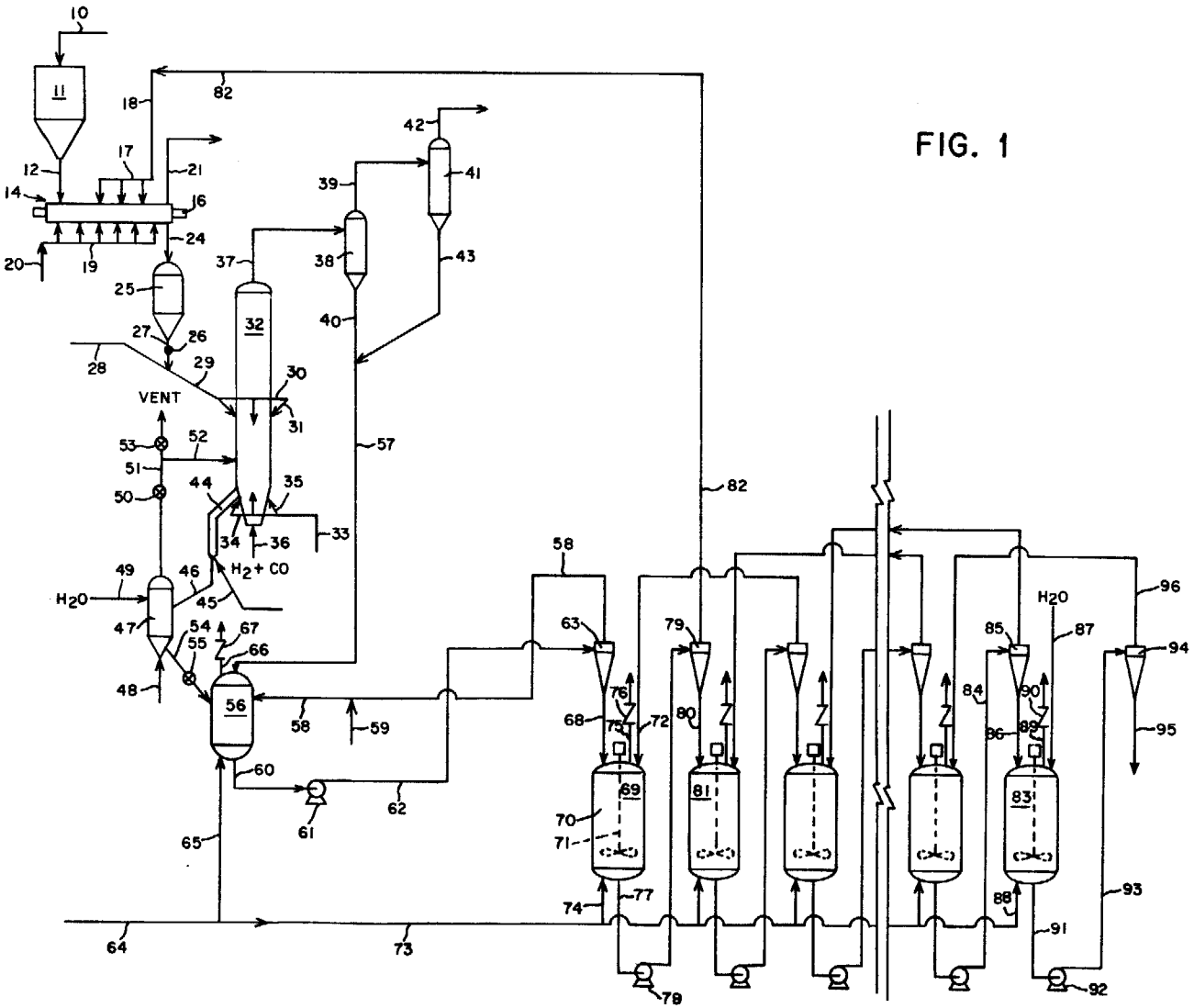
FIG. 1 in the drawing is a schematic flow diagram of a catalytic coal gasification process in which alkali metal constituents of the catalyst are recovered and reused in the process.

The process depicted in FIG. 1 is one for the production of methane by the gasification of a bituminous coal, subbituminous coal, lignite or similar carbonaceous solids with steam at high temperature in the presence of a carbon-alkali metal catalyst prepared by impregnating the feed solids with a solution of an alkali metal compound or a mixture of such compounds and thereafter heating the impregnated material to a temperature sufficient to produce an interaction between the alkali metal and the carbon present. It will be understood that the alkali metal recovery system utilized is not restricted to this particular gasification process and that it can be employed in conjunction with any of a variety of other conversion processes in which alkali metal compounds or carbon-alkali metal catalysts are used to promote the reaction of steam, hydrogen, oxygen or the like with carbonaceous feed materials to produce a char, coke or similar solid product containing alkali metal residues from which alkali metal compounds are recovered for reuse as the catalyst or a constituent of the catalyst. It can be employed, for example, for the recovery of alkali metal compounds from various processes for the gasification of coal, petroleum coke, lignite, organic waste materials and similar solids feed streams which produce spent carbonaceous solids. Other conversion processes with which it may be used include operations for the carbonization of coal and similar feed solids, for the liquefaction of coal and related carbonaceous materials, for the retorting of oil shale, for the partial combustion of carbonaceous feed materials, and the like. Such processes have been disclosed in the literature and will be familiar to those skilled in the art.

In the process depicted in FIG. 1, a solid carbonaceous feed material such as bituminous coal, subbituminous coal, lignite or the like that has been crushed to a particle size of about 8 mesh or smaller on the U.S. Sieve Series Scale is passed into line 10 from a feed preparation plant or storage facility that is not shown in the drawing. The solids introduced into line 10 are fed into a hopper or similar vessel 11 from which they are passed through line 12 into feed preparation zone 14. This zone contains a screw conveyor or similar device, not shown in the drawing, that is powered by a motor 16, a series of spray nozzles or similar devices 17 for the spraying of alkali metal-containing solution supplied through line 18 onto the solids as they are moved through the preparation zone by the conveyor, and a similar set of nozzles or the like 19 for the introduction of steam into the preparation zone. The steam, supplied through line 20, serves to heat the impregnated solids and drive off the moisture. In order to prevent oxidation of alkali metal constituents in the feed preparation zone, it is important that no air or any other gas containing molecular oxygen be introduced into the preparation zone. Steam is withdrawn from the feed preparation zone through line 21 and passed to a condenser, not shown, from which it may be recovered for use as makeup water or the like. The alkali metal-containing solution is recycled through line 82 from the alkali metal recovery section of the process, which is described in detail hereafter.

It is preferred that sufficient alkali metal-containing solution be introduced into feed preparation zone 14 to provide from about 1 to about 50 weight percent of the alkali metal compound or mixture of such compounds on the coal or other carbonaceous solids. From about 1 to about 15 weight percent is generally adequate. The dried impregnated solid particles prepared in zone 14 are withdrawn through line 24 and passed to a closed hopper or similar vessel 25. From here they are discharged through a star-wheel feeder or equivalent device 26 in line 27 at an elevated pressure sufficient to permit their entrainment into a stream of high pressure steam, recycle product gas, or similar inert gas substantially free of molecular oxygen introduced into line 29 via line 28. The carrier gas and entrained solids are passed through line 29 into manifold 30 and fed from the manifold through feedlines 31 and nozzles, not shown in the drawing, into gasifier 32. In lieu of or in addition to hopper 25 and starwheel feeder 26, the feed system may employ parallel lock hoppers, pressurized hoppers, aerated standpipes operated in series, or other apparatus to raise the input feed solids stream to the required pressure level.

It is generally preferred to operate the gasifier 32 at a pressure between about 100 and about 2000 psig. The carrier gas and entrained solids will normally be introduced at a pressure somewhat in excess of the gasifier operating pressure. The carrier gas may be preheated to a temperature in excess of about 300° F. but below the initial softening point of the coal or other feed material employed. Feed particles may be suspended in the carrier gas in a concentration between about 0.2 and about 5.0 pounds of solid feed material per pound of carrier gas. The optimum ratio for a particular system will depend in part upon feed particle size and density, the molecular weight of the gas employed, the temperature of the solid feed material and input gas stream, the amount of alkali metal compound employed and other factors. In general, ratios between about 0.5 and about 4.0 pounds of solid feed material per pound of carrier gas are preferred.

Gasifier 32 comprises a refractory lined vessel containing a fluidized bed of carbonaceous solids extending upward within the vessel above an internal grid or similar distribution device not shown in the drawing. The bed is maintained in the fluidized state by means of steam introduced through line 33, manifold 34 and peripherally spaced injection lines and nozzles 35 and by means of recycle hydrogen and carbon monoxide introduced through bottom inlet line 36. The particular injection system shown in the drawing is not critical and hence other methods for injecting the steam and recycle hydrogen and carbon monoxide may be employed. The injected steam, hydrogen and carbon monoxide should normally be free of substantial quantities of air or any other gas containing molecular oxygen since the oxygen will tend to react with the alkali metal constituents in the char to form undesirable alkali metal compounds which are not active catalysts and cannot be reused as constituents of the alkali metal-containing catalyst when recovered from the spent char by water washing or other methods.

The injected steam reacts with carbon in the feed material in the fluidized bed in gasifier 32 at a temperature within the range between about 800° F. and about 1600° F. and at a pressure between about 100 and about 2000 psig. Due to the equilibrium conditions existing in the bed as the result of the presence of the carbon-alkali metal catalyst and the recycle hydrogen and carbon monoxide injected near the lower end of the bed, the reaction products will normally consist essentially of methane and carbon dioxide. Competing reactions which in the absence of the catalyst and the recycle gases would ordinarily tend to produce additional hydrogen and carbon monoxide are suppressed. The ratio of methane to carbon dioxide in the raw product gas thus formed will preferably range from about 1 to about 1.4 moles per mole, depending upon the amount of hydrogen and oxygen in the feed coal or other carbonaceous solids. The coal employed may be considered as an oxygenated hydrocarbon for purposes of describing the reaction. Wyodak coal, for example, may be considered as having the approximate formula $CH_{0.84}O_{0.20}$, based on the ultimate analysis of moisture and ash-free coal and neglecting nitrogen and sulfur. The reaction of this coal with steam to produce methane and carbon dioxide is as follows:

$$1.24H_2O(g) + 1.8CH_{0.84}O_{0.20} \rightarrow 0.8CO_2 + CH_4$$

Under the same gasification conditions, coals of higher oxygen content will normally produce lower methane to carbon dioxide ratios and those of lower oxygen content will yield higher methane to carbon dioxide ratios.

The gas leaving the fluidized bed in gasifier 32 passes through the upper section of the gasifier, which serves as a disengagement zone where particles too heavy to be entrained by the gas leaving the vessel are returned to the bed. If desired, this disengagement zone may include one or more cyclone separators or the like for removing relatively large particles from the gas. The gas withdrawn from the upper part of the gasifier through line 37 will normally contain methane and carbon dioxide produced by reaction of the steam with carbon, hydrogen and carbon monoxide introduced into the gasifier as recycle gas, unreacted steam, hydrogen sulfide, ammonia and other contaminants formed from the sulfur and nitrogen contained in the feed material, and entrained fines. This gas is introduced into cyclone separator or similar device 38 for removal of the larger fines. The overhead gas then passes through line 39 into a second separator 41 where smaller particles are removed. The gas from which the solids have been separated is taken overhead from separator 41 through line 42 and the fines are discharged downward through dip legs 40 and 43. These fines may be returned to the gasifier or passed to the alkali metal recovery section of the process as discussed hereafter.

After entrained solids have been separated from the raw product gases described above, the gas stream may be passed through suitable heat exchange equipment for the recovery of heat and then processed for the removal of acid gases. Once this has been accomplished, the remaining gas, consisting primarily of methane, hydrogen and cabon monoxide, may be cryogenically separated into a product methane stream and a recycle stream of hydrogen and carbon monoxide, which is returned to the gasifier through line 36. Conventional gas processing equipment can be used. Since a detailed description of this downstream gas processing portion of the process is not necessary for an understanding of the invention, it has been omitted.

The fluidized bed in gasifier 32 is comprised of char partacles formed as the solid carbonaceous feed material undergoes gasification. The composition of the char particles will depend upon the amount of mineral matter present in the carbonaceous material fed to the gasifier, the amount of the alkali metal compound or mixture of such compound impregnated into the feed material, and the degree of gasification that the char particles undergo while in the fluidized bed. The lighter char particles, which will have a relatively high content of carbonaceous material, will tend to remain in the upper portion of the fluidized bed. The heavier char particles, which will contain a relatively small amount of carbonaceous material and a relatively large amount of ash and alkali metal residues, will tend to migrate toward the bottom of the fluidized bed. A portion of the heavier char particles are normally withdrawn from the bottom portion of the fluidized bed in order to eliminate ash and thereby prevent it from building up within the gasifier and other vessels in the system.

During the gasification process taking place in reactor 32, alkali metal constituents of the gasification catalyst react with mineral constituents of the coal and other carbonaceous solids to form alkali metal residues containing water-soluble alkali metal compounds such as carbonates, sulfides and the like and water-insoluble compounds such as alkali metal alumino-silicates, alkali metal iron sulfides and similar compounds. The process of the invention is based in part upon the discovery that air exposure of the char and alkali metal residues withdrawn from the gasifier prior to treatment with water or an aqueous solution will result both in a decrease in the amount of alkali metal constituents that can be leached from the char particles during the treatment process and in the formation of undesirable alkali metal constituents in the aqueous solution resulting from the treatment step. Exposure of the char to air prior to water washing may result in as much as a 50 percent decrease in the amount of water-soluble alkali metal constituents that can be recovered by washing the char with water or an aqueous solution. Furthermore, exposure of the char to air or similar gas containing molecular oxygen may result in the formation of undesirable alkali metal sulfates and alkali metal thiosulfates in the alkali metal-enriched solution exiting the treatment step. Similarly, exposure of this solution to air or an oxygen-containing gas may result in the oxidation of alkali metal sufides to alkali metal sulfates and alkali metal thiosulfates. The latter alkali metal compounds are undesirable because they are not as catalytically active as are alkali metal carbonates, alkali metal sulfides and alkali metal hydroxides, the compounds that will ordinarily be the major constituents of the solution produced by treating an alkali metal-containing char that was not exposed to molecular oxygen with water or an aqueous solution. The formation of these undesirable constituents will result in the need for an increased amount of makeup alkali metal compounds to replace the original catalytically active constituents of the alkali metal-containing catalyst.

To improve the economics of the catalytic gasification process described above and other catalytic conversion processes where alkali metal residues are formed and withdrawn with char and ash from the gasifier or reaction zone and alkali metal constituents are subsequently recovered by treating the char containing the residues with water or an aqueous solution, it is desirable to withdraw the char from the reaction zone in an atmosphere free of molecular oxygen, and subsequently treat the char particles in an oxygen-free atmosphere. Care should also be taken to prevent the wash solution produced in the treatment step from coming in contact with air or molecular oxygen. The alkali metal constituents formed in the wash solution are then used in the conversion process as at least a portion of the alkali metal constituents which comprise the alkali metal-containing catalyst. Contact with air is normally prevented by blanketing the char in an inert atmosphere as it is withdrawn from the gasifier or reaction zone and passed to the alkali metal recovery section of the process. During treatment to recover alkali metal constituents, blanketing with an inert gas may also be used to prevent contact of the char or recovered alkali metal constituents with air or molecular oxygen. As used herein "inert atmosphere" or "inert gas" refer to an atmosphere or gas that is substantially free of molecular oxygen.

Referring again to FIG. 1, char particles containing carbonaceous material, ash and alkali metal residues are continuously withdrawn through line 44 from the bottom of the fluid bed in gasifier 32. The particles flow downward through line 44 countercurrent to a stream of steam or other inert elutriating gas free of air or molecular oxygen introduced through line 45. A portion of the water-soluble alkali metal constituents in the char will consist of alkali metal sulfides and it is important that the char not come in contact with air or an oxygen-containing gas in order to prevent the oxidation of the alkali metal sulfides to undesirable sulfates and thiosulfates. A preliminary separation of solids based on differences in size and density takes place in line 44. The lighter particles having a relatively large amount of carbonaceous material tend to be returned to the gasifier and the heavier particles having a relatively high content of ash and alkali metal residues continue downward through line 46 into fluidized bed withdrawal zone 47.

The particles in vessel 47 are maintained in the fluidized state by means of steam, nitrogen or other inert gas substantially free of air or molecular oxygen introduced into the bottom of the withdrawal zone through line 48. It is again important that no air or other oxygen-containing gas be passed into the withdrawal zone where it can contact the hot char and thereby oxidize the alkali metal residues since such oxidation will result in a decrease in the amount of alkali metal constituents that can be recovered from the char and in the formation of undesirable constituents such as alkali metal sulfates, alkali metal thiosulfates and the like upon aqueous washing. The hot char particles in the fluidized bed in vessel 47 will normally be cooled to a temperature below about 200° F. by the introduction of water into the upper part of the vessel through line 49. Again, care should be taken to prevent the introduction of air or other oxygen-containing gas with the water. It is preferred to regulate the rate at which the solids are withdrawn from the gasifier by controlling the pressure in vessel 47. This can be done by using control valve 50 to throttle the gas taken overhead through line 51, thus avoiding the necessity for passing high temperature solids through a slide valve or similar device. The gases from line 51 may be returned to the gasifier through line 52 or vented through valve 53. The solid particles in vessel 47 are now ready for treatment to recover alkali metal constituents.

The solid particles in vessel 47 are passed through line 54 containing pressure letdown valve 55 into slurry tank 56. Here the particles are combined with char fines recovered from the raw product gas through dip legs 40 and 43 and line 57 and the resulting mixture is slurried with water or an aqueous solution containing water-soluble alkali metal constituents injected into the slurry tank through line 58. When starting up the process water will be injected into line 58 through line 59 and passed into slurry tank 56. Once the process is operating continuously, however, the solution injected into tank 56 will consist of an aqueous solution containing alkali metal constituents produced by withdrawing the slurry formed in tank 56 through line 60 and passing it by means of pump 61 through line 62 to hydroclone, centrifuge, filter or similar liquid-solids separation device 63 where a large portion of the char and fines are removed from the liquid, which is recovered overhead of the separation device and recycled to the slurry tank through line 58.

During the slurrying process which takes place in tank 56, a portion of the water-soluble constituents present in the alkali metal residues passed into the slurry tank with the char will dissolve in the water thereby further enriching the solution in alkali metal constituents. If the char has not been exposed to molecular oxygen or a gas containing molecular oxygen such as air prior to its introduction into tank 56, the alkali metal constituents that dissolve in the aqueous medium will be primarily in the form of alkali metal carbonates, alkali metal sulfides, and alkali metal hydroxides. It is important that these constituents not be exposed to air or any other oxygen-containing gas since the alkali metal sulfides may have a tendency to oxidize and form undesirable alkali metal sulfates and alkali metal thiosulfates. These latter alkali metal compounds are relatively inactive catalysts as compared to alkali metal carbonates, hydroxides and sulfides and therefore the more of them that are produced during the recovery step, the greater is the amount of active alkali metal compounds that must be introduced into the system to compensate for the loss of the more active constituents. To prevent the slurry in tank 56 from coming in contact with air or another oxygen-containing gas; steam, nitrogen, carbon dioxide or a similar gas free of molecular oxygen is passed through lines 64 and 65 into the bottom of the tank and allowed to pass through the slurry into line 66 and through check valve 67. By keeping a positive pressure of inert gas in tank 56, contact of the slurry with air is prevented. The inert gas removed overhead from check valve 67 may be vented to the atmosphere or recovered for reuse.

The particles removed from separation device 63 will contain water-insoluble alkali metal constituents, water-soluble alkali metal constituents that did not pass into solution during slurrying in tank 56 and entrained liquid containing water-soluble constituents. The water-soluble alkali metal constituents remaining in the particles are recovered by passing the solids through a multistage countercurrent water extraction unit which includes a plurality of tanks or vats, classifiers, screw-fed contacters, thickeners, continuous centrifuges or the like. The number of actual stages employed in the extraction system will depend to a large extent upon the composition of the solids fed to the system and the particular contacting conditions utilized. Each stage in the particular system shown in the drawing includes a closed vat or tank containing a stirrer, means for countercurrent circulation of liquids and solids from one tank to another, a hydroclone, filter, centrifuge or similar liquid-solids separation device, and means for maintaining a blanket of inert gas free of molecular oxygen in each stage to prevent contact of the slurry with air.

The solids removed from the slurry fed to separation device 63 are passed through line 68 into the final stage 69 of the multistage liquid-solids extraction train. This stage comprises a mixing tank 70 which contains a stirrer 71. In the mixing tank the solids are slurried with an alkali metal-containing solution introduced into the tank through line 72 and the resultant slurry is agitated by the stirrer. The temperature in the tank is normally maintained at a value near the boiling point of the aqueous medium. Water-soluble alkali metal constituents present in the solid particles are in part extracted by the liquid in contact with the particles. The slurry in tank 70 is kept under an inert atmosphere free of molecular oxygen by passing steam, nitrogen, carbon dioxide or a similar inert gas into tank 70 via lines 64, 73, and 74. This gas is continuously passed upward through the slurry in the tank into line 75 and through check valve 76 thereby creating a positive pressure in the tank which prevents air from entering the tank and contacting the slurry. The gas removed overhead through check valve 76 may be vented to the atmosphere or recovered for reuse in the process.

The slurry which is formed in stage 69 is withdrawn from the bottom of tank 70 through line 77 and circulated by means of pump 78 to hydroclone, centrifuge, filter or similar liquid-solids separation device 79 where the solids are removed from the liquid. These solid particles, from which a portion of the water-soluble alkali metal constituents have been extracted, are discharged through line 80 into stage 81 of the apparatus. The liquid separated from the solids in hydroclone 79, richer in alkali metal constituents than the liquid in stage 81, is withdrawn from the hydroclone through line 82. This solution will normally be recycled through lines 82, 18 and 17 to feed preparation zone 14. Here, the coal or similar carbonaceous feed material is impregnated with the alkali metal constituents in the aqueous solution. If the concentration of the alkali metal constituents in the recycle stream is undesirably low, the solution may be concentrated by removing excess water before it is returned to the feed preparation zone. The solution may be treated with carbon dioxide prior to recycle in order to convert the alkali metal constituents into alkali metal carbonates and bicarbonates. In lieu of recycling the solution in line 82 to the feed preparation zone, alkali metal constituents can be separated from the solution by evaporation and crystallization, precipitation or other methods and added to the feed material in solid form.

Stage 81 and the other intermediate stages of the recovery train are generally similar to stage 69. In each of these stages, solids separated from a relatively concentrated liquid stream in the hydroclone or other liquid-solids separator associated with that stage are discharged into a less concentrated solution and the concentrated solution from the hydroclone or similar device is passed downstream for contact with solids having a higher content of water-soluble alkali metal constitutents. Slurry from each stage is pumped to the hydroclone in the adjacent upstream stage for separation into liquid and solid components. Steam, nitrogen, carbon dioxide or similar gas substantially free of air or molecular oxygen is continuously passed through the slurry to maintain an inert atmosphere in the tank and thereby prevent oxidation of the alkali metal constituents in the solid particles and in the aqueous medium comprising the slurry. In the initial stage 83 of the train, incoming slurry from the second stage flows through line 84 to hydroclone or the like 85, from which the solids are discharged through line 86 into substantially pure water introduced into the stage through line 87. Steam, nitrogen, carbon dioxide or a similar gas substantially free of air or molecular oxygen is injected into the stage through line 88 and passes upward through the slurry into line 89 and through check valve 90.

The slurry formed in initial stage 83 by the mixing of substantially pure water with solids from which most of the water-soluble alkali metal constituents have been extracted results in a slurry of solid particles in a very dilute alkali metal solution. The slurry is withdrawn through line 91 by means of pump 92 and passed through line 93 to hydroclone or similar device 94. The solids withdrawn from the hydroclone through line 95 will normally contain, among other substances, small amounts of carbonaceous material, ash, and a small amount of water-insoluble alkali metal constituents. These solids may be further treated in such a fashion as to recover the water-insoluble alkali metal constituents or they may be disposed of by landfill, used for construction purposes, or employed in other applications. The very dilute alkali metal solution recovered from hydroclone 94 is passed through line 96 to the second stage of the recovery train.

In the embodiment of the invention shown in FIG. 1 and described above, char particles containing alkali metal residues are treated for the recovery of water-soluble alkali metal constituents by subjecting the particles to water washing in a countercurrent multistage water extraction system. It will be understood that the process of the invention is not limited to this particular alkali metal recovery system and can be used in conjunction with any type of alkali metal recovery system in which particles containing alkali metal residues are treated for the recovery of alkali metal constituents. In addition to water extraction systems designed differently than the one shown in FIG. 1, the process of the invention can also be used in conjunction with alkali metal recovery systems in which particles containing alkali metal residues are treated with an aqueous solution containing a substance that will facilitate the conversion of water-insoluble alkali metal constituents in the residues into water-soluble alkali metal constituents thereby increasing the amount of alkali metal constituents recovered for reuse in the conversion process. Examples of such recovery systems include, but are not limited to, systems in which particles containing alkali metal residues are treated with an aqueous solution of a mineral acid at relatively low temperatures and systems in which such particles are treated with calcium hydroxide in the presence of water at a temperature between about 250° F. and about 700° F.

The nature and objects of the invention are further illustrated by the results of laboratory tests. The first two series of tests illustrate that when char containing alkali metal residues is exposed to air prior to water washing, the resultant water wash solution will contain a high concentration of undesirable alkali metal sulfates and alkali metal thiosulfates. The third series of tests illustrates that air exposure of char containing alkali metal residues prior to water washing will decrease the amount of alkali metal constituents recovered during the water wash step.

In the first series of tests, an Illinois No. 6 coal was impregnated with potassium carbonate and gasified with steam in the presence of carbon monoxide and hydrogen. Char produced during the gasification process was withdrawn from the gasifier in a nitrogen atmosphere substantially free of air and subsequently cooled under complete nitrogen blanketing. A portion of the char removed from the gasifier in this manner was slurried with 20 times its weight of distilled water in a flask which was also maintained under a nitrogen atmosphere. The resulting aqueous solution was separated from the solids and analyzed for sulfate sulfur, sulfide sulfur, thiosulfate sulfur, carbonate and potassium. It was assumed that the remaining anions were present in the hydroxide form. In all cases the amount of hydroxide calculated by difference compared favorably to the measured pH of the solution. Similar tests were conducted on char removed from the gasifier under incomplete nitrogen blanketing, i.e., char that had been exposed to air. The results of these tests are set forth below in Table I.

TABLE I

PERCENT POTASSIUM ASSOCIATED WITH VARIOUS ANIONS IN WATER WASH SOLUTION

| Run | Char Exposed to Air | Sulfate Anion | Thio-sulfate Anion | Sulfide Anion | Car-bonate Anion | Hydroxide Anion |
|---|---|---|---|---|---|---|
| 1 | yes | 4.7 | 15.3 | 2.9 | 47.6 | 29.3 |
| 2 | yes | 3.3 | 3.5 | 7.9 | 45.8 | 39.5 |
| 3 | yes | 3.8 | 9.9 | 7.1 | 53.1 | 26.1 |
| 4 | yes | 4.0 | 9.1 | 6.7 | 53.8 | 26.4 |
| 5 | yes | 2.8 | 9.5 | 5.6 | 60.4 | 21.7 |
| 6 | yes | 5.7 | 11.5 | 8.8 | 31.7 | 42.3 |
| 7 | no | 1.0 | 3.0 | 12.0 | 65.0 | 19.0 |
| 8 | no | 0.2 | 0.9 | 15.7 | 39.3 | 43.9 |

It can be seen from Table I that the amount of potassium present in the form of potassium sulfate and potassium thiosulfate in the solution resulting from water washing the char substantially decreases while the amount present as potassium sulfide substantially increases if the char is not exposed to air prior to and during water washing. Since potassium sulfate and potassium thiosulfate are less active catalysts as compared to potassium sulfide and potassium carbonate, the data in the Table indicate the importance of preventing the char from being exposed to air or molecular oxygen while it is being withdrawn from the gasification zone and while it is passed to the water wash portion of the recovery process.

In the second series of tests, Illinois No. 6 coal impregnated with potassium carbonate was steam gasified in the presence of hydrogen and carbon monoxide and the resultant char was removed from the gasifier so as not to be exposed to air. Samples of this char were spread on a flat pan and exposed to air for varying periods of time. The samples were then washed with twenty times their weight in water and the amount of sulfur compounds in the solution were determined. The results of these tests are set forth below in Table II.

TABLE II

SULFUR COMPOUNDS IN SOLUTION PRODUCED FROM WATER WASHING CHAR EXPOSED TO AIR FOR VARYING LENGTHS OF TIME

| Run | Air Exposure Prior to Water Leaching | Sulfide Sulfur (PPM) | Thiosulfate Sulfur (PPM) | Sulfate Sulfur (PPM) |
|---|---|---|---|---|
| 1 | No exposure | 1050 | 125 | 15 |
| 2 | 10 minutes | 230 | 680 | 375 |
| 3 | 3 hours | 50 | 1240 | 500 |

The data listed in Table II further indicate the importance of preventing exposure of the char to air or any other gas containing molecular oxygen. The data clearly show that a very short exposure time will significantly decrease the amount of alkali metal sulfides present in solution while at the same time greatly increasing the amount of undesirable alkali metal thiosulfates and alkali metal sufates. It can be seen from the Table that after the char was exposed to air for three hours, 95 percent of the sulfide sulfur was converted to oxidized sulfur forms.

The third series of tests illustrate that exposure of the char to air will decrease the amount of alkali metal constituents recovered in a subsequent water wash. Illinois No. 6 coal impregnated with potassium carbonate was steam gasified in the presence of hydrogen and carbon monoxide under conditions such that 90 percent of the carbon in the coal was converted into gases. A portion of the char produced in the gasifier was removed from the gasifier in such a manner as to preclude its exposure to air and was cooled in an air-free nitrogen atmosphere. The cooled char was washed several times in a nitrogen atmosphere free of air with fresh distilled water in a water-to-char weight ratio of three to one or four to one. Each wash was conducted near the boiling point of water and for a residence time of about 60 minutes. The aqueous solution from each wash was then analyzed for potassium. Prior to washing the char it was analyzed for water-soluble potassium. In order to determine the effect of air exposure on the amount of potassium recovered, the above procedure was repeated with samples of the same char that had been exposed to air for one minute, thirty minutes, and twenty-four hours respectively. The above procedure was also repeated using a similar char that had been exposed to air for about three months. The results of these tests are set forth in FIG. 2.

Figure 2:
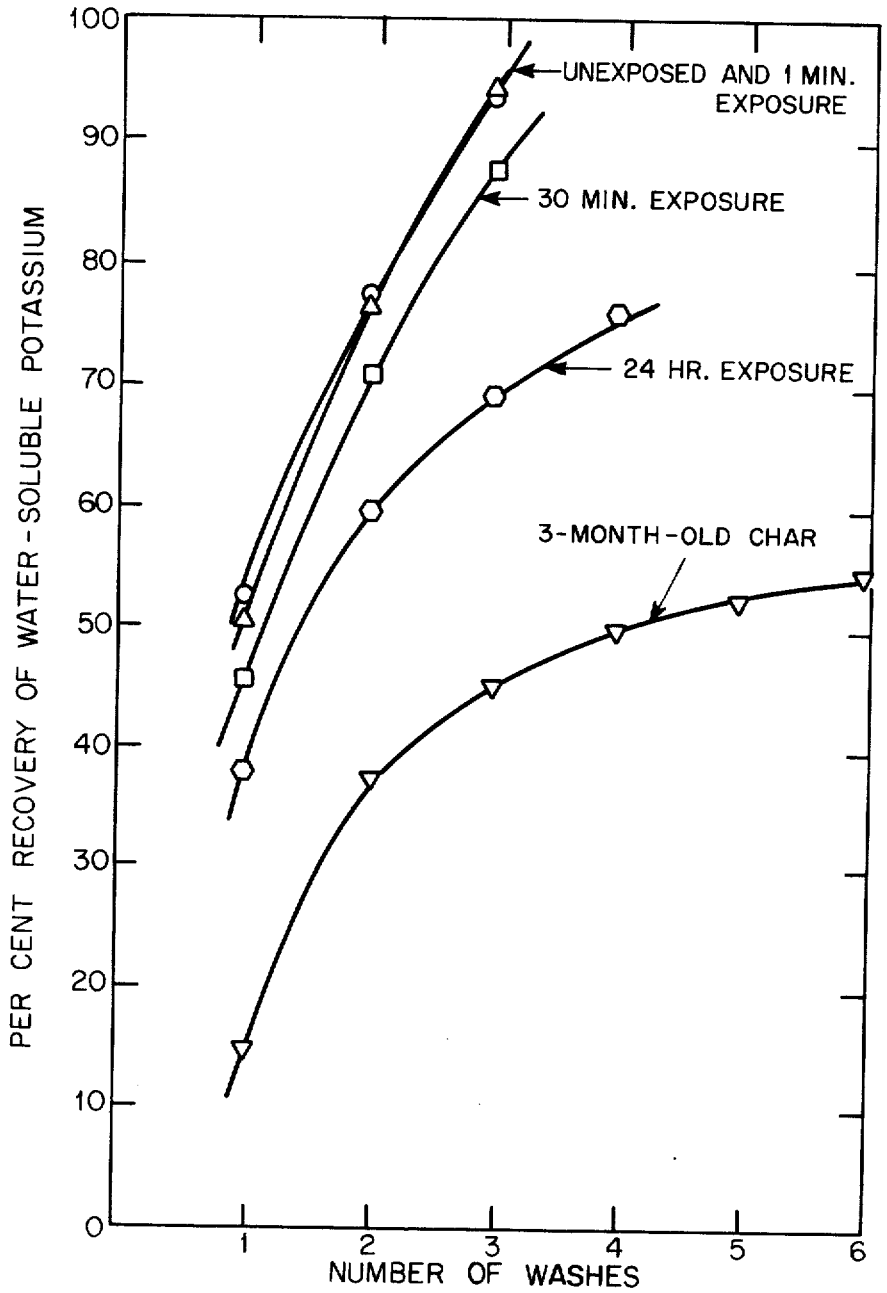
FIG. 2 is a plot showing the effect of exposing char produced by the fluid bed gasification of a coal impregnated with potassium carbonate to air prior to water washing on the amount of water-soluble potassium recoverable by water washing.

It can be seen from FIG. 2 that the longer the char is exposed to air the smaller is the quantity of water-soluble potassium that is recovered by water washing. Three washings with distilled water recovered about 92 percent of the water-soluble potassium from unexposed char; whereas a twenty-four hour exposure resulted in only about a 68 percent recovery. After three washes the three-month old char yielded a total recovery of less than half that of the unexposed char. The data set forth in FIG. 2 further illustrate the importance of preventing air exposure of char prior to treatment for recovering alkali metal constituents.

It will be apparent from the foregoing that the invention provides a process which makes it possible to recover increased amounts of catalytically active alkali metal constituents from alkali metal residues produced during catalytic gasification and similar high temperature conversion processes. As a result, the need for costly makeup alkali metal compounds is reduced, thereby lowering the overall cost of the conversion process.

We claim:

1. In a process for the conversion of a solid carbonaceous feed material in the presence of an alkali metal-containing catalyst into liquids and/or gases wherein said conversion takes place in a reaction zone to produce particles containing alkali metal residues, said particles are transferred to an alkali metal recovery zone where they are treated for the recovery of alkali metal constituents, and the recovered alkali metal constituents are used in said conversion process as at least a portion of the alkali metal constituents comprising said alkali metal-containing catalyst, the improvement which comprises:

(a) withdrawing and passing said particles from said reaction zone to said alkali metal recovery zone in the substantial absence of molecular oxygen during the entire period of said withdrawal and passage; and (b) treating said particles throughout the entirety of said recovery zone in the substantial absence of molecular oxygen for the recovery of said alkali metal constituents.

2. A process as defined in claim 1 wherein said conversion process comprises gasification.

3. A process as defined in claim 1 wherein said conversion process comprises liquefaction.

4. A process as defined in claim 1 wherein at least a portion of said alkali metal-containing catalyst comprises potassium carbonate.

5. A process as defined in claim 1 wherein said particles containing said alkali metal residues are treated with water in said recovery zone to produce an aqueous solution containing water-soluble alkali metal constituents and said aqueous solution is recycled to said process where said alkali metal constituents are used as at least a portion of said alkali metal constituents comprising said alkali metal-containing catalyst.

6. A process as defined in claim 1 wherein said particles containing said alkali metal residues are treated with an aqueous solution of mineral acid in said recovery zone to produce an aqueous solution containing water-soluble alkali metal constituents and said aqueous solution is recycled to said conversion process where said alkali metal constituents are used as at least a portion of said alkali metal constituents comprising said alkali metal-containing catalyst.

7. A process as defined in claim 1 wherein said particles containing said alkali metal residues are treated with calcium hydroxide in the presence of liquid water at a temperature between about 250° F. and about 700° F. in said recovery zone to produce an aqueous solution containing water-soluble alkali metal constituents and said aqueous solution is recycled to said conversion process where said alkali metal constituents are used as at least a portion of said alkali metal constituents comprising said alkali metal-containing catalyst.

8. A process as defined in claim 5 wherein said recovery zone comprises a multistage countercurrent water extraction system.

9. A process as defined in claim 1 wherein said carbonaceous feed material comprises coal.

10. In a process for the production of a methane-containing gas wherein coal is gasified in the presence of a carbon-alkali metal catalyst and particles containing alkali metal residues are produced, said particles are transferred from the gasifier to an alkali metal recovery zone where they are treated with an aqueous solution for the recovery of alkali metal constituents, and said recovered alkali metal constituents are used in said conversion process as at least a portion of the alkali metal constituents comprising said carbon-alkali metal catalyst, the improvement which comprises:

(a) withdrawing and passing said particles from said gasifier to said alkali metal recovery zone in the substantial absence of air during the entire period of said withdrawal and passage; and (b) treating said particles with said aqueous solution throughout the entirety of said recovery zone in the substantial absence of air for the recovery of said alkali metal constituents.

11. A process as defined in claim 10 wherein said particles are treated in said recovery zone under an inert atmosphere of carbon dioxide.

12. A process as defined in claim 10 wherein said particles are treated in said recovery zone under an inert atmosphere of steam.

13. A process as defined in claim 10 wherein said particles are treated in said recovery zone under an inert atmosphere of nitrogen.

14. A process as defined in claim 10 wherein said aqueous solution contains a mineral acid.

15. A process as defined in claim 10 wherein said aqueous solution contains calcium hydroxide and said treatment is carried out at a temperature between about 250° F. and about 700° F.

* * * * *